2/18/86 XR 4,570,480

United States Patent [19]

Fontenot et al.

[11] Patent Number: 4,570,480

[45] Date of Patent: Feb. 18, 1986

[54] METHOD AND APPARATUS FOR DETERMINING FORMATION PRESSURE

[75] Inventors: John E. Fontenot; Richard D. Murphy, both of Houston, Tex.

[73] Assignee: NL Industries, Inc., New York, N.Y.

[21] Appl. No.: 595,320

[22] Filed: Mar. 30, 1984

[51] Int. Cl.[4] ..... E21B 47/06; E21B 49/00

[52] U.S. Cl. ..... 73/155; 175/48

[58] Field of Search ..... 73/155; 175/48

[56] References Cited

U.S. PATENT DOCUMENTS

| | | | |
|---|---|---|---|
| 3,525,258 | 8/1970 | Fowler et al. | 73/155 |
| 3,690,167 | 9/1972 | Chase, Jr. et al. | 73/155 |
| 3,809,170 | 5/1974 | Ilfrey et al. | 175/48 |
| 3,968,844 | 7/1976 | Walther, Jr. et al. | 73/155 |
| 4,372,380 | 2/1983 | Smith et al. | 73/155 |
| 4,442,895 | 4/1984 | Lagus et al. | 73/155 |

*Primary Examiner*—Howard A. Birmiel

*Attorney, Agent, or Firm*—Carl O. McClenny; William E. Johnson, Jr.

[57] ABSTRACT

Method and apparatus are provided for determining the formation pressure. The magnitude of formation pressure may be derived as a function of changes in bottomhole pressure following swabbing the borehole to draw formation fluids into the borehole, monitoring the borehole for influx of formation fluids, determining the reduced pressure due to swabbing, repeating the swabbing and monitoring steps until an influx of formation fluids is detected thereby determining the pressure of the formation.

15 Claims, 3 Drawing Figures

FIG. 1
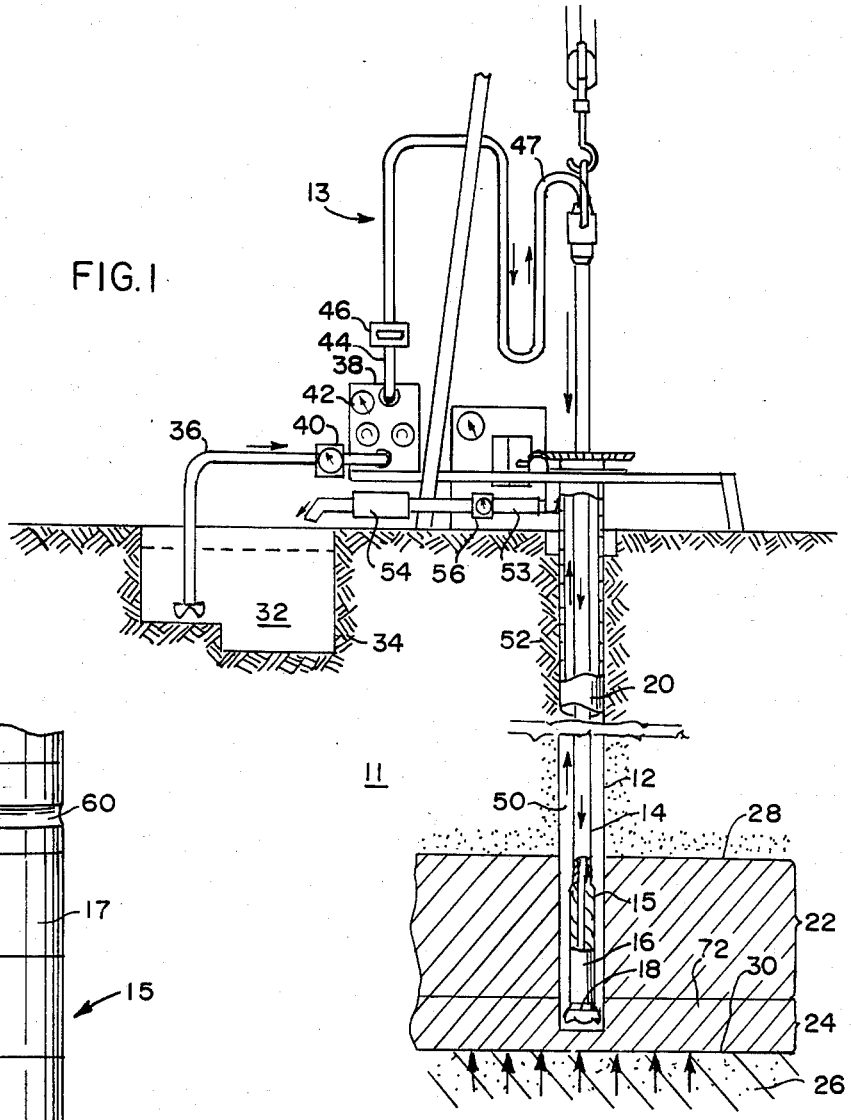
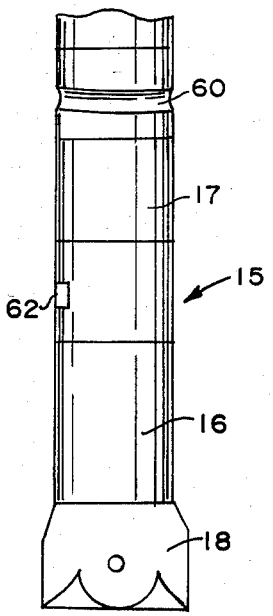
FIG. 3

METHOD AND APPARATUS FOR DETERMINING FORMATION PRESSURE

This invention relates to methods and apparatus used while drilling oil and gas wells and more particularly relates to a method and apparatus for determining the pore pressure of a formation by reducing bottomhole pressure thereby to draw formation fluids into the borehole, detecting the influx of formation fluids into the borehole, and determining the reduced bottomhole pressure which is related to the pore pressure.

BACKGROUND OF THE INVENTION

It is well known that oil and gas deposits are contained in subterranean earth formations and that boreholes are drilled into these formations for the purpose of recovering these petroleum deposits. During the drilling operations, it is common to pump a drilling fluid, or drilling mud, into the borehole through the drill string to lubricate and cool the bit, to maintain hydrostatic pressure head in the borehole to overbalance the subterranean formation pressures, and to carry the drill cuttings from the bit to the surface of the earth.

It is also well known that subterranean formation pressures generally increase with depth. Low permeability formations, such as shales, exhibit a pressure that is a measure of the pressure exerted by fluid trapped within non-interconnected interstices or pores of the formation. The measure of this pressure is commonly called "formation pore pressure." In permeable formations the exhibited pressure is a measure of the fluid trapped within the interconnected interstices or pores of the formation, and is generally referred to as "formation pressure." Further, it is generally known that low-permeability formations, such as shales, commonly overlie abnormally high-pressured fluid within the porous formation.

A problem in all oil and gas well drilling operations is the maintenance of sufficient hydrostatic pressure head of drilling mud to overbalance the subterranean formatin pressure at the bottom of the borehole. A pressure overbalance or "bottomhole pressure differential" must be maintained in order to prevent high-pressured fluids within porous formations from being released through the borehole to the surface. An uncontrolled release of high pressured fluid from within the formation through the borehole is commonly referred to as a "blowout". A blowout can cause irreparable damage to the borehole and surface equipment and death and injury to drilling personnel located near the surface drilling equipment.

Excessive hydrostatic pressure head, together with additional pressure due to friction while circulating the drilling mud or while lowering the drill string into the borehole, can cause the formation to be fractured with possible resultant loss of mud to the surrounding formation. Thus, maintenance of a proper bottomhole pressure differential, i.e., overbalance, is important to well safety. However, this is difficult since the pressure varies with the drilling mud being used and the formation being encountered. Exact knowledge of formation pressure is necessary but is not easily obtained. Generally accepted practice requires the removal of the drill string and the running of a wireline log to determine the bottomhole pressure differential with the resultant loss of time and expenditure of money.

A general object of this invention is to provide an improved system that may be used in connection with downhole testing during drillling operations, wherein it is possible to measure formation pore pressure without removing the drill string from the hole.

Still another object is to provide an improved system for measuring formation pressures with accuracy.

Yet another object is to provide apparatus for obtaining the pressure measurements of subsurface earth formations in connection with surface drilling operations wherein a minimum amount of rig time is lost.

Other objects and features of the invention will become apparent upon consideration of the following description thereof when taken in connection with the accompanying drawings.

BRIEF DESCRIPTION OF THE DRAWINGS

FIG. 1 illustrates a conventional drilling apparatus incorporating a pressure determination assembly of the present invention.

FIG. 3 is a schematic representation of the instrumentation system in a configuration as it could be practiced.

SUMMARY OF THE INVENTION

Figure 2:
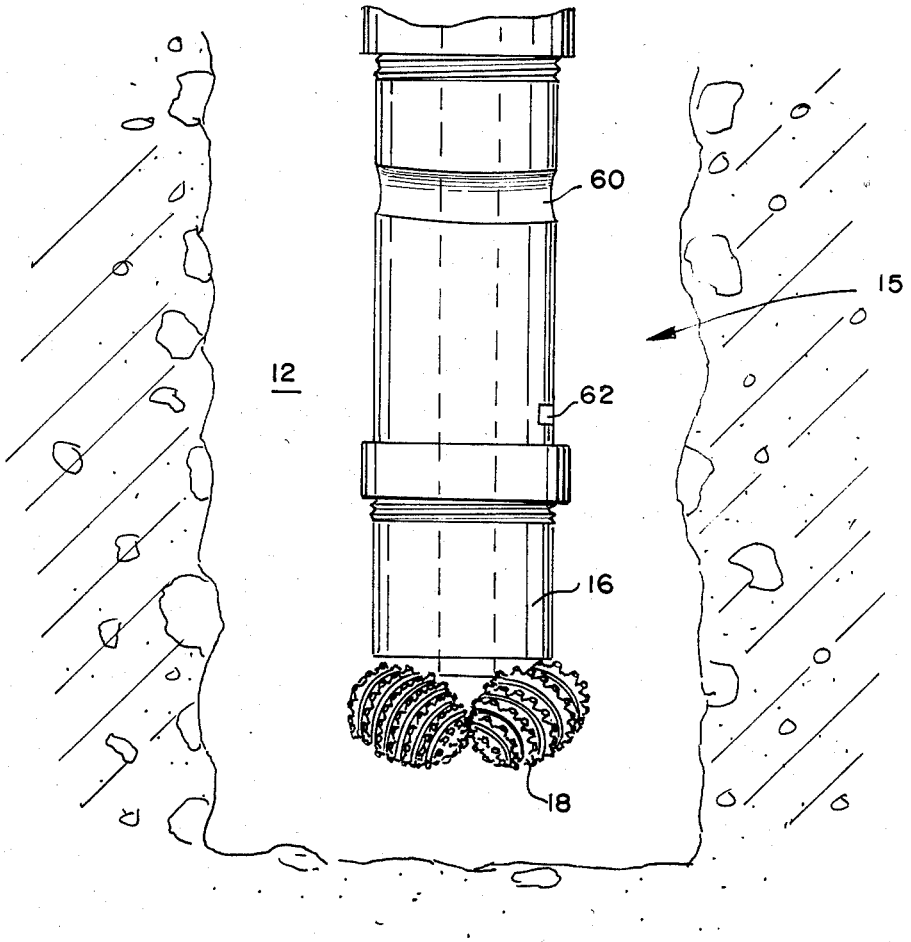
FIG. 2 is a simplified front elevation of a portion of a drilling string incorporating apparatus such as is used in connection with the present invention.

According to one aspect of the present invention a method is disclosed for determining the pressure of a formation traversed by a borehole including the steps of reducing bottomhole pressure of the fluid contained in the lower portion of the borehole, and, upon monitoring of formation fluid influx, determining the reduced borehole pressure which is indicative of the pressure of the formation.

The inventin comprises apparatus for determining the pore pressure of a formation traversed by a borehole and includes a drill string for insertion into the borehole, means for detecting influx of fluids from the formation into the borehole, means for reducing the pressure in the borehole, and a pressure measurement means responsive to the pressure reducing means.

DETAILED DESCRIPTION OF THE INVENTION

Referring now to FIG. 1, a typical borehole 12 is shown traversing a subsurface formation 11. Suspended in the borehole 12 is the drilling apparatus conventionally employed in the drilling operation. In particular, drilling rig 13 is shown in place over borehole 12, drill string 14, pressure measurement sub 15, drill collar 16 and drill bit 18 within borehole 12 with casing 20 set to a preselected depth. Borehole 12 is shown in cross section as it penetrates a normally pressured shale formation 22 and a higher pressure layer 24 of the shale formation. Formation 24 overlies an abnormally high-pressured permeable formation 26.

Drilling mud 32 is drawn from mud circulating pit 34 through a mud intake pipe 36 to a mud pump 38. Mud weight detector 40 on the pipe 36 measures the weight in lbs/gal. of the mud flowing into the mud pump 38. The pump pressure of pump 38 can be varied and the operating pressure of pump 38 is indicated by meter 42. Drilling mud 32 is then pumped through a pump discharge pipe 44 where the mud flow rate is measured by a flow rate detector 46.

Flexible housing 47 conducts mud 32 from the pump discharge pipe 44 through drill string 14 and drill collar 16 to drill bit 18 where it is discharged past cutting heads and circulated upwardly through the annulus 50 between drill string 14 and collar 16 and the borehole 12, and through annulus 52 between drill string 14 and casing 20 in the direction as shown by the arrows. Mud 32 is then forced sequentially through the borehole discharge pipe sections 53, mud weight detector 56 and adjustable choke 54 to thereafter be discharged into mud pit 34 for reuse. Detector 56 measures and indicates the weight in lbs/gal. of the mud flow out of the borehole 12. The choke device 54 is a radially compressive sleeve that can be opened or closed to vary the rate of mud flow out of the borehole. As the sleeve is closed, the flow is "choked" and back pressure is exerted on the mud circulating in the borehole which in turn increases the downhole pressure.

With reference now to FIG. 2, the measurement sub 15 in addition to component parts which are not shown, includes an influx detector 60 and pressure measurement means 62 coupled serially together. In actual practice. the configuration may approach that shown in FIG. 3 where influx and pressure subs are separated by short collars 16, 17.

The pressure gauge 62 and influx detector 60 are coupled to a cable or a downhole computing and telemetry system, not shown. The cable in turn includes electric conductors for transmitting the output signals from the pressure gauge 62 and influx detector 60 to apparatus at the earth's surface. The downhole computing system continuously monitors the influx detector and the bottomhole pressure gauge. The computing system continuously transmits the measurements to the surface for analysis.

The function of the influx detector 60 is to determine the displacement of the drilling mud, which normally occupies the immediate vicinity of the detector 60, by formation fluids drawn from the formation by the effective swabbing action to be described. One such detector is a fluid resistivity detector which may consist of a separate tubular member screw-threaded to sub 15, an electrically conducting annular electrode and an insulator of rubber or other non-conducting material for separating and electrically insulating the tubular member from the electrode. The electrode is electrically connected to a conductor by means of a connector which is electrically insulated from the annular member. The electrical conductor is connected to suitable resistance measuring apparatus which electrical measuring apparatus is also connected to the drill string 14 so as to measure the electrical resistance of the fluid between the electrode and the drill string 14.

Other suitable types of influx detectors 60 include pressure transducers illustrated in U.S. Pat. No. 4,297,880, acoustic wave measurement devices illustrated in U.S. Pat. No. 3,776,032 and gamma ray detectors, these patents being incorporated herein by reference.

The operation of the apparatus described above is as follows:

The drilling bit 18 penetrates a subsurface stratum of which the formation pressure is desired or advisable. The mud pump 38 is turned off thereby ceasing circulation of mud 32 down the drill string 14 and up the annulus 50, 52.

During drilling operations the bottomhole pressure is determined by factors including the hydrostatic head of drilling mud in the borehole 12, frictional pressure losses in the mud due to the borehole walls and the drill string 14, the weight of the drilling mud being used and the back pressure of the choke 54. Under static conditions bottomhole pressure is simply the head of drilling mud. To bracket the formation pressure, a pressure drop due to swabbing with the drill string is created. The drill bit function is similar to a swabbing section in that it forms a constricted region about the drill string which drives fluids up the annulus thereby reducing the borehole pressure below the drill bit. Swabbing causes a pressure drop which reduces the bottomhole pressure to a pressure which may be at, above or below the formation pressure. If the reduced pressure is below the formation pressure, formation fluids will migrate into the borehole where the fluids mix with the borehole fluids, i.e. the drilling mud. The influx of formation fluids may be detected using the methods listed below and the detection of influx indicates that the borehole pressure, at its reduced level, is below the formation pressure. The reduced borehole pressure for different swabbing rates may be calculated knowing the drill string velocity and the initial bottomhole pressure. The required pressure drop due to swabbing must exceed the pressure difference between the mud hydrostatic pressure and the formation pressure. The difference is normally about 250 psi.

The desired pressure drop is inserted in equation (2) described below and the swabbing velocity required to produce the desired pressure drop is determined for the equipment and drilling mud in use.

In the effective swabbing action, the drill string 14 is moved upwardly at the predetermined velocity, thereby drawing drilling mud from the lower end of the borehole 12 up the annulus 50, 52 toward the surface thereby reducing presure. The velocity required to achieve a required swab pressure may be calculated using the method described in an article entitled "An Improved Method for Calculating Swab/Surge and Circulating Pressures in a Drilling Well"; SPE paper 4521, June 28, 1974, this article being incorporated herein by reference. In calculating the required velocity of the fluid resulting from drill string movement, the swab pressure is given by $$P = \frac{f\rho L\,(V_{sw})^2}{25.81d\,(1\alpha)} \tag{1}$$

Solving for $V_{sw}$, the required velocity, $$V_{sw} = \sqrt{\frac{P(25.81)\,d(1-\alpha)}{f\,\rho\,L}}\,, \tag{2}$$

where

P=swab pressure
f=laminar friction factor
$\rho$=mud density
L=length of the section
$V_{sw}$=velocity of the drill string
d=diameter of the borehole
$\alpha$=ratio of diameter of drill string (collars) to diameter of borehole If the influx of formation fluids is not detected, the pressure reducing step is repeated to further reduce the bottomhole pressure. The velocity of the withdrawing drill string 14 is increased so that the pressure drop is increased and a lower reduced bottomhole pressure is achieved. Following each successive pressure reduction step, monitoring of the borehole fluids is performed to detect any influx of formation fluids. Several pressure reducing steps may be necessary. In due course, if the swab pressure exceeds the overbalance pressure, formation fluids will move into the borehole and past the influx detector 60 which will indicate their presence. The monitoring step includes mixing the fluids contained in the lower portion of the borehole by rotating the drill string.

The mixing can also be accomplished by circulating drilling fluids down the drill string 14, out the drill bit 18, and into the borehole 12 below the bit. The influx detectors 60 are preferably located on the exterior of the drill pipe about 15 to 30 feet above the drill bit.

Numerous variations and modifications may obviously be made in the apparatus herein described without departing from the present invention. Accordingly, it should be clearly understood that the forms of the invention described herein and shown in the figures of the accompanying drawings are illustrative only and are not intended to limit the scope of the invention.

What is claimed is:

1. A method for determining the pressure of a formation being traversed by a borehole during drilling thereof by a drill string comprising the steps of:

a. reducing bottomhole pressure of the fluid contained in the lower portion of said borehole by withdrawing said drill string from said lower portion of said borehole thereby causing a swabbing action;

b. monitoring said borehole for fluid influx from said formation surrounding said borehole said influx being caused by said swabbing action; and c. upon monitoring of formation fluid influx, determining the reduced borehole pressure which is indicative of the pressure of said formation.

2. The method of claim 1 wherein determining said reduced borehole pressure comprises measuring bottomhole pressure while reducing bottomhole pressure.

3. The method of claim 1 wherein said withdrawing step includes determining a predetermined withdrawing velocity from the characteristics of said drill string, said borehole, said borehole fluid and the difference between the bottomhole pressure and the reduced bottomhole pressure.

4. The method of claim 3 wherein said withdrawing step of said drill string is at said predetermined velocity.

5. The method of claim 1 comprising additionally mixing said borehole fluids prior to monitoring said borehole fluids.

6. The method of claim 1 wherein said monitoring step comprises the measurement of physical or chemical properties of the borehole fluids.

7. The method of claim 6 wherein said measurements are selected from a group consisting of resistivity of said borehole fluids, acoustic transmission in said borehole fluids and gamma ray attenuation rates in said borehole fluids.

8. Apparatus for determining the pressure of a formation being traversed by a borehole during drilling thereof by a drill string comprising:

a. a drill string for insertion into said borehole;

b. a means for reducing the fluid pressure in said borehole by withdrawing said drill string at a predetermined velocity;

c. a pressure measurement means responsive to said pressure reducing means; and d. means for detecting influx of fluids from said formation into said borehole.

9. The apparatus of claim 8 wherein said influx detecting means detects physical or chemical properties of said borehole fluids.

10. The apparatus of claim 9 wherein said fluid influx detecting means is selected from a group consisting of a resistivity detector, pressure transducer, acoustic wave transducer and detector, and gamma ray detector.

11. The apparatus of claim 8 comprising additionally a means for measuring bottomhole pressure.

12. The apparatus of claim 8 wherein said influx detecting means further includes a means for circulating borehole fluids past said influx detecting means.

13. The apparatus of claim 8 further comprising a means for determining the velocity at which said drill string is withdrawn from said borehole.

14. The apparatus of claim 8 further comprising a means for mixing said borehole fluids after reducing said bottomhole pressure and prior to detecting formation fluid influx.

15. The apparatus of claim 14 wherein said mixing means comprises a means for circulating borehole fluids.

* * * * *